United States Patent [19]

Im

[11] Patent Number: 5,000,337

[45] Date of Patent: Mar. 19, 1991

[54] SAFETY DRINKING CONTAINER

[76] Inventor: Margaret Im, 5216-G Cherry Crest la., Charlotte, N.C. 28217

[21] Appl. No.: 512,332

[22] Filed: Apr. 23, 1990

[51] Int. Cl.[5] ..... B65D 41/00

[52] U.S. Cl. ..... 220/90.2; 222/531

[58] Field of Search ..... 220/90.2, 90.6; 222/531, 541, 566

[56] References Cited

U.S. PATENT DOCUMENTS

| | | | |
|---|---|---|---|
| 4,561,557 | 12/1985 | Park et al. | 220/90.2 |
| 4,582,213 | 4/1986 | Park et al. | 220/90.2 |
| 4,712,702 | 12/1987 | Ayabe et al. | 220/90.2 |
| 4,792,083 | 12/1988 | Yassur | 220/90.2 X |
| 4,852,776 | 8/1989 | Patton | 220/90.2 X |

*Primary Examiner*—Steven M. Pollard
*Attorney, Agent, or Firm*—Leon Gilden

[57] ABSTRACT

A drinking container organization is provided to ensure sanitary transmission of fluid from within the container to a user thereof. The container includes a removable tab member, wherein the tab member is mounted to a grasp ring, the grasp ring includes a tether line, with the tether line directed through the container secured to an inverted funnel member, wherein upon lifting of the tab member, the inverted funnel member is oriented for use by an individual through the container opening. A further modification of the instant invention includes a removable tape, including an underlying straw mounted within a recess underlying the tape. A further container organization includes a pour spout positioned adjacent a recess to permit access to a forward end of the pour spout to enable ease of pivotment of the pour spout relative to a lid of the container.

2 Claims, 5 Drawing Sheets

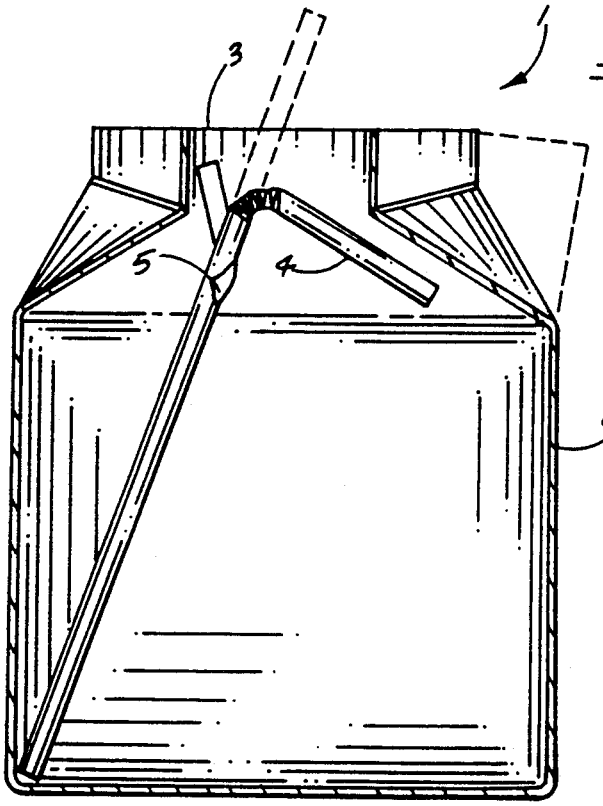
PRIOR ART
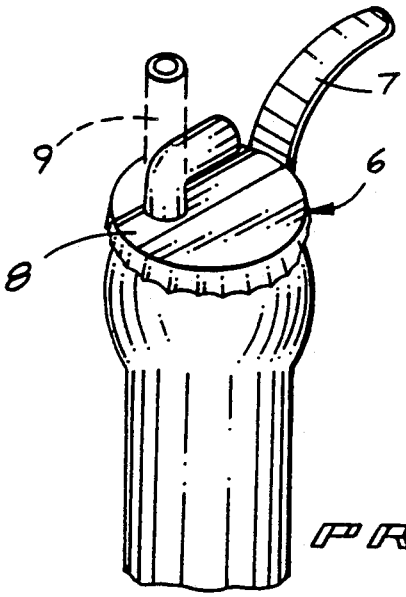
PRIOR ART

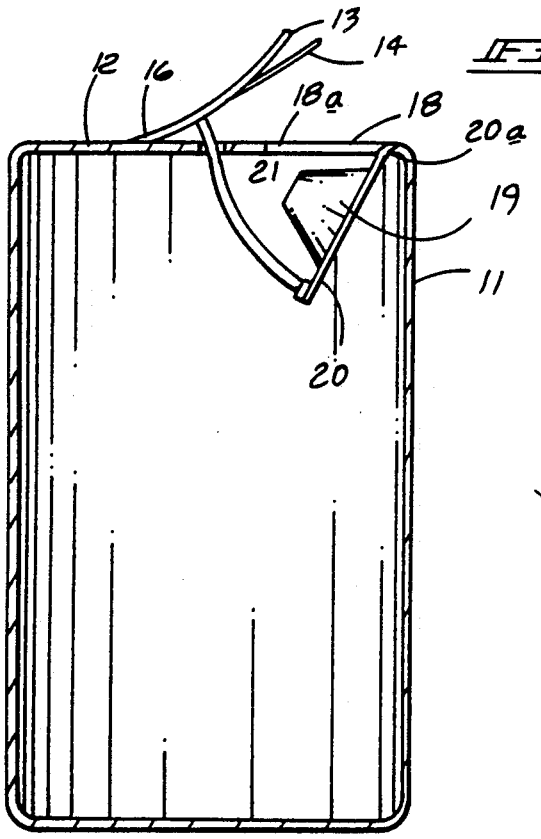
Fig 5
Fig 6
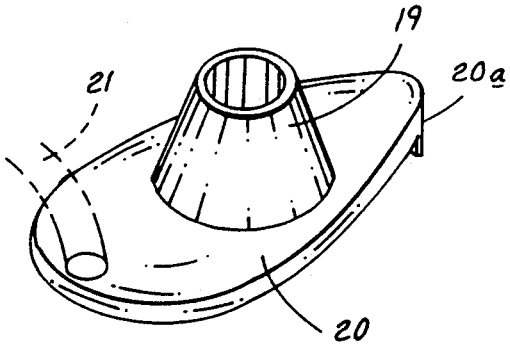
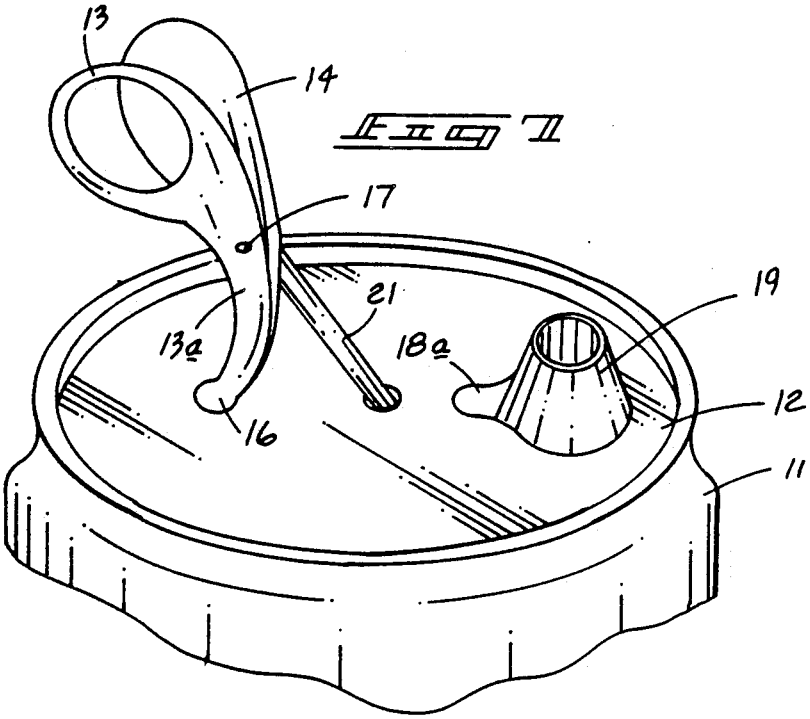
Fig 7

Fig 8
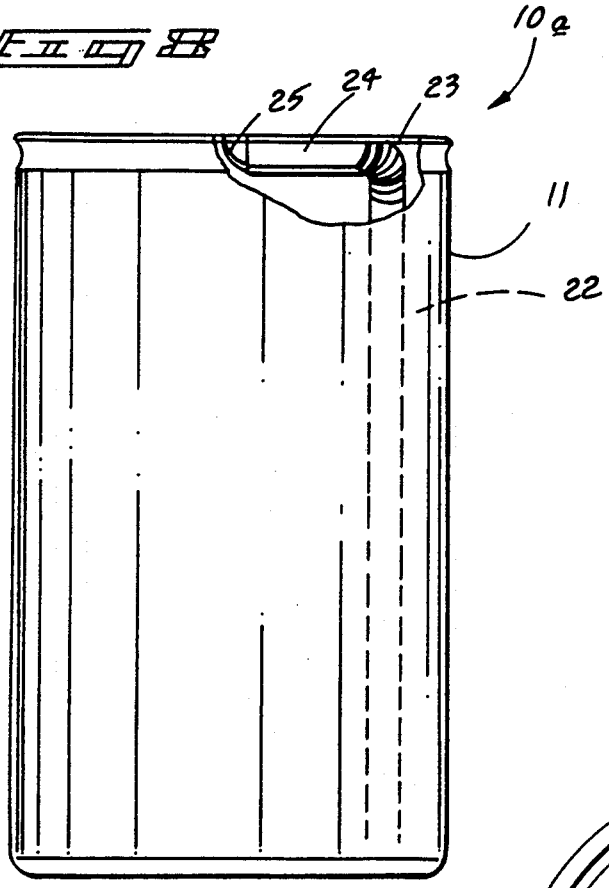
Fig 9
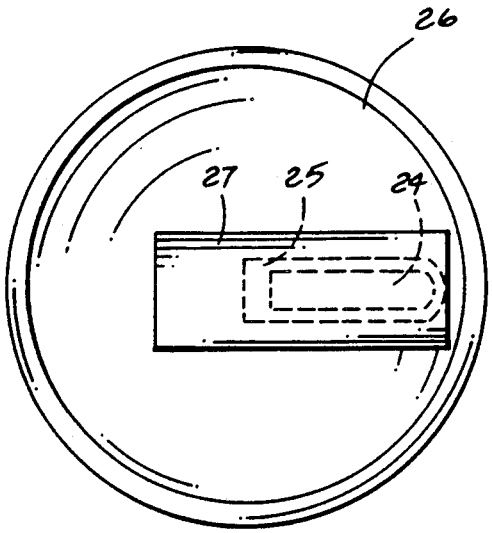
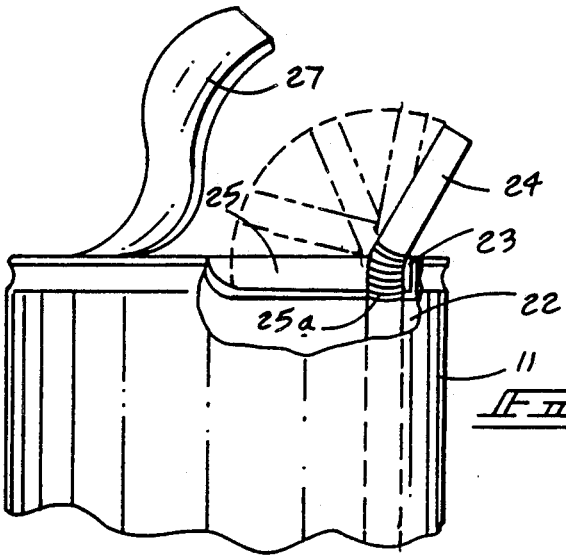
Fig 10

SAFETY DRINKING CONTAINER

BACKGROUND OF THE INVENTION

1. Field of the Invention

The filed of invention relates to containers, and more particularly pertains to a new and improved safety drinking container wherein the same provides mechanical association of a tab mounted within the lid to a fluid conduit member mounted within the container.

2. Description of the Prior Art

Contemporary society includes various dangers, such as the transmission of communicable diseases and the like, as a factor. Particularly in the packaging and delivering of various food commodities, such bacteria and viruses are available as contaminants within the food chain due to the handling of such food commodities from one geographical position to another. The prior art has included various structural organizations to minimize danger of contamination of food contained within various packaging structures. Examples of the prior art include U.S. Pat. No. 4,194,674 to Pearson wherein a drinking straw is wholly contained within a cardboard or paper-type container mounted to an interior surface of the container for access upon opening of said container.

U.S. Pat. No. 2,844,267 to Petericcone sets forth a drinking straw mounted within a recess of a bottle cap accessible upon removal of a strip overlying the recess.

U.S. Pat. No. 3,194,470 to Zimmerman, et al. sets forth a liquid container wherein a drinking straw is mounted within the cap of the container for use upon opening of the container.

U.S. Pat. No. 4,744,477 to Wofford wherein a bottle cap includes a structure to secure a drinking straw in alignment with a cap upon opening of the bottle to provide access to the straw by an individual.

U.S. Pat. No. 4,265,363 to Conn sets forth a container with a drinking straw positioned for direction through the closure cap of the container permitting a spring-out motion of the straw upon removal of the cap.

As such, it may be appreciated that there continues to be a need for a new and improved safety drinking container as set forth by the instant invention wherein the same addresses both the problems of ease of use as well as effectiveness in construction in providing access to a sanitary straw for use in association with an enclosed container and as such, the present invention substantially fulfills this need.

SUMMARY OF THE INVENTION

In view of the foregoing disadvantages inherent in the known types of container structures now present in the prior art, the present invention provides a safety drinking container wherein the same provides positioning of a drinking funnel hingedly mounted to a lid of a container for use by an individual upon removal of a lid closure tab. As such, the general purpose of the present invention, which will be described subsequently in greater detail, is to provide a new and improved safety drinking container which has all the advantages of the prior art container apparatus and none of the disadvantages.

To attain this, the present invention includes a drinking container organization provided to ensure sanitary transmission of fluid from within the container to a user thereof. The container includes a removable tab member, wherein the tab member is mounted to a grasp ring, the grasp ring includes a tether line, with the tether line directed through the container secured to an inverted funnel member, wherein upon lifting of the tab member, the inverted funnel member is oriented for use by an individual through the container opening. A further modification of the instant invention includes a removable tape, including an underlying straw mounted within a recess underlying the tape. A further container organization includes a pour spout positioned adjacent a recess to permit access to a forward end of the pour spout to enable ease of pivotment of the pour spout relative to a lid of the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety drinking container which has all the advantages of the prior art container apparatus and none of the disadvantages.

It is another object of the present invention to provide a new and improved safety drinking container which may be easily and efficiently manufactured and marketed.

It is a further object of the present invention to provide a new and improved safety drinking container which is of a durable and reliable construction.

An even further object of the present invention is to provide a new and improved safety drinking container which is susceptible of a low cost of manufacture with regard to both materials and labor, and which accordingly is then susceptible of low prices of sale to the consuming public, thereby making such safety drinking containers economically available to the buying public.

Still yet another object of the present invention is to provide a new and improved safety drinking container which provides in the apparatuses and methods of the prior art some of the advantages thereof, while simultaneously overcoming some of the disadvantages normally associated therewith.

Still another object of the present invention is to provide a new and improved safety drinking container wherein the same provides mounting of a drinking tube in association with a container to provide a sanitary drinking member for use independent of an associated exterior surface of a container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view, partially in section, of a prior art container including a straw member mounted therewithin.

FIG. 2 is an isometric illustration of a further prior art safety drinking container.

FIG. 5 is an orthographic cross-sectional view of the instant invention.

FIG. 6 is an isometric illustration of the drinking funnel structure utilized by the instant invention.

FIG. 7 is an isometric illustration of the lid structure of the instant invention in an operative position relative to the lid.

FIG. 8 is an isometric illustration of a further safety drinking container of the instant invention.

FIG. 9 is an orthographic top view of the container as illustrated in FIG. 8.

FIG. 10 is an orthographic side view, partially in section, of the drinking container as illustrated in FIG. 8, in an operative configuration.

DESCRIPTION OF THE PREFERRED EMBODIMENT

Figure 3:
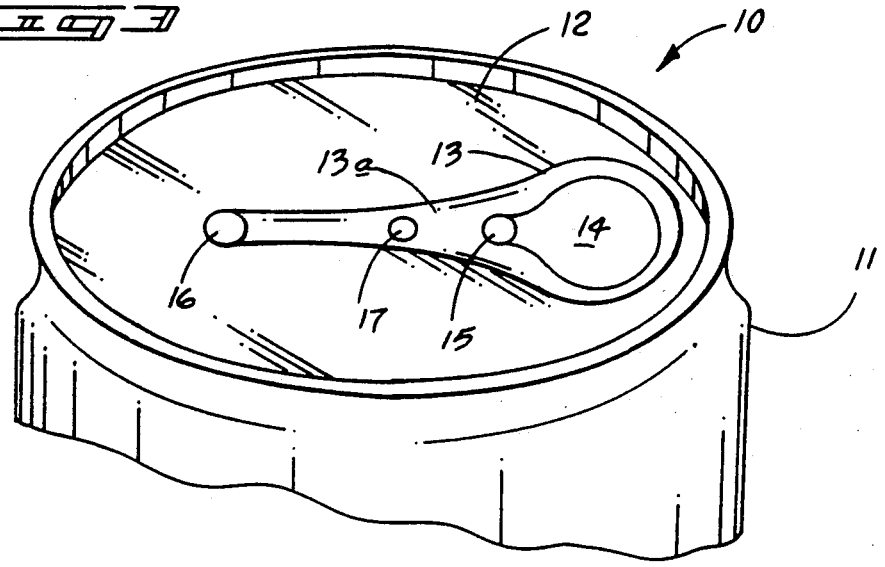
FIG. 3 is an isometric illustration of the lid structure of the instant invention.
Figure 4:
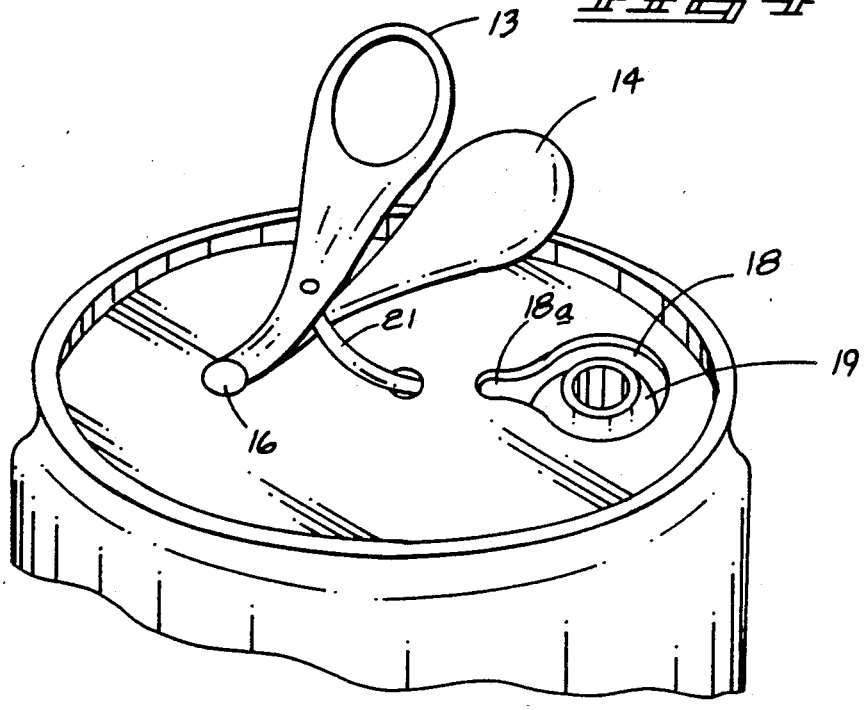
FIG. 4 is an isometric illustration of the lid structure of the instant invention in a partially opened configuration.

With reference now to the drawings, and in particular to FIGS. 1 to 12 thereof, a new and improved safety drinking container embodying the principles and concepts of the present invention and generally designated by the reference numerals 10, 10*a*, and 10*b* will be described.

FIG. 1 illustrates a prior art container 1, wherein the container body 2 includes a neck portion 3 that may be opened to a configuration to provide access to a drinking straw 4 that is mounted within a tab member 5 for use by an individual. FIG. 2 illustrates a further safety lid structure 6, whereupon lifting of a flap 7, access to a straw 9 is provided normally mounted within a slot 8.

More specifically, the safety drinking container 10 of the instant invention essentially comprises a cylindrical container body 11, with a lid 12 mounted integrally to an upper end of the container body. The lid 12 includes pull ring 13 mounted to a forward terminal end of an elongate body 13*a*. The pull ring 13 is mounted diametrically aligned with a forward terminal end of the elongate body 13*a*, and includes a tab member 14 fixedly mounted overlying an opening 18 formed within the lid 12. The tab member 14 defines a closure in its first position mounted overlying the opening 18. The opening 18 is defined by an annular central portion including a diametrically aligned leg opening 18*a* directed interiorly and diametrically aligned with the lid 12. A closure tab mounting rivet 15 securably associates the body 13*a* with the tab member 14, whereupon lifting of the pull ring 13, the tab member 14 is removed relative to the opening 18. A body mounting rivet 16 mounts a rear terminal end of the elongate body 13*a* to the lid 12. A tether line mount positioned medially of the elongate body mounts a flexible tether line 21. The tether line 21 is mounted at its upper terminal end to the tether line mount 17 and at its lower end to a drinking funnel base 20. The base 20 is formed of a generally elliptical configuration defined by a predetermined area greater than that of the opening 18 and the leg opening 18*a* to permit overlying of the opening 18 upon lifting of the ring 13 to its full rearward or second position, as illustrated in FIG. 7, whereupon an inverted drinking funnel 19 of a generally truncated conical configuration is mounted on the drinking funnel base 20. The drinking funnel 19 defines a base circle at its lowermost terminal end substantially equal to the annular central opening portion of the opening 18. The funnel 19 is in fluid communication with contents contained within the container 11. The lower terminal end of the tether line 21 is mounted to a forward terminal end of the elliptical base 20, wherein a base hinge 20*a* is mounted to a rear terminal end of the base 20, wherein the base hinge 20 is aligned with the forward terminal end mounting of the tether line 21 and the access of the drinking funnel 19, all positioned upon the major access defined by the elliptical configuration of the base 20 to permit secure frictional engagement of the funnel 19 within the opening 18 upon complete lifting of the tab member 14 and the associated pull ring 13, as illustrated in FIG. 7.

FIGS. 8, 9, and 10 illustrate a modified safety drinking container 10*a*, wherein the container body 11 includes a drinking straw 22 directed interiorly of the container 11, wherein the straw 22 includes a drinking straw joint 23 pivotally mounting a drinking straw upper portion 24 thereon. The upper portion 24 normally is arranged to be received within a complementarily configured through 25 mounted within the modified lid 26 of the container 10*a*. The joint 23 is positioned within a trough opening 25*a* securing the straw in a fixed orientation relative to the lid 26. Upon removal of an overlying flexible closure tape 27, access to the upper portion 24 is provided.

Figure 11:
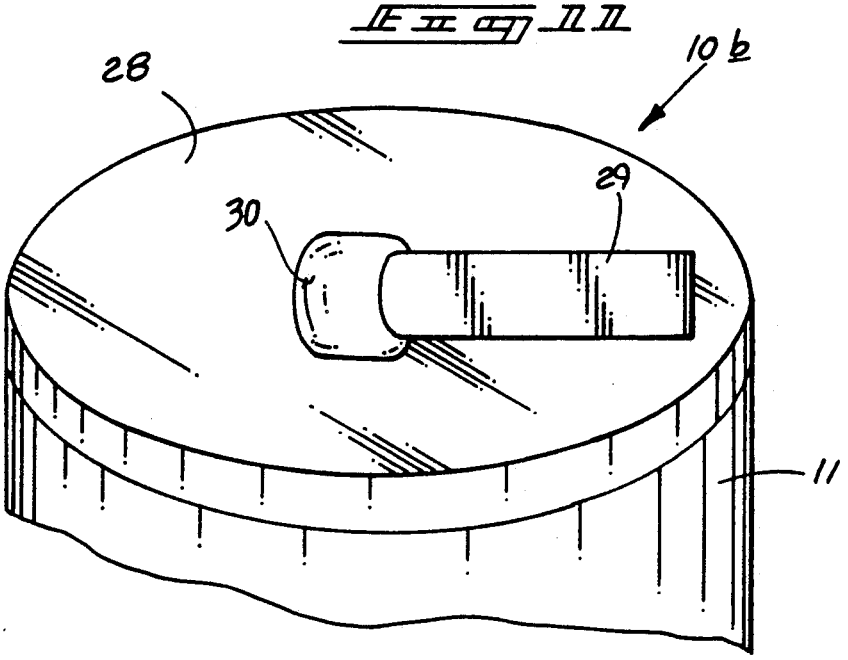
FIG. 11 is an isometric illustration of a further container lid structure as utilized by the instant invention.
Figure 12:
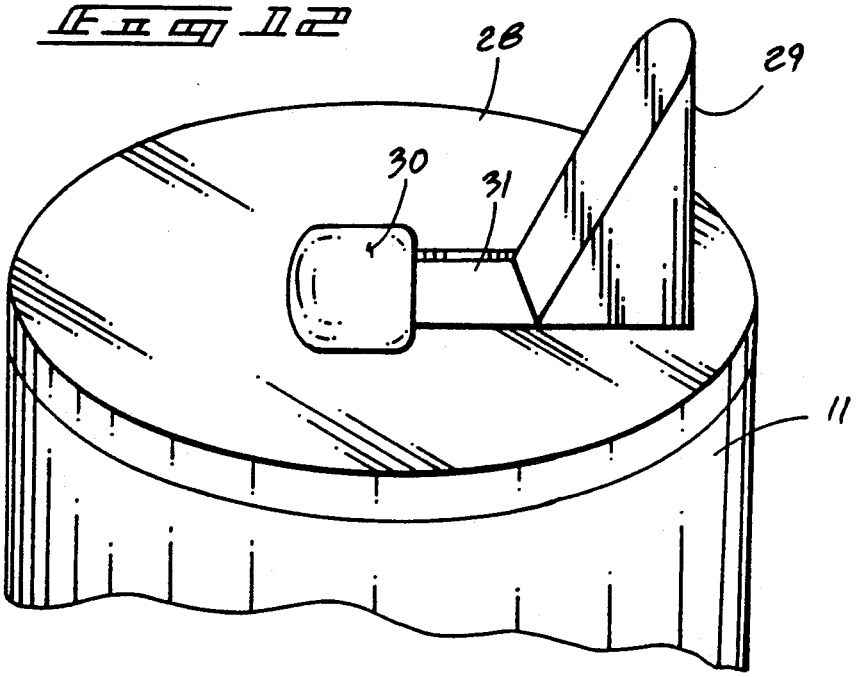
FIG. 12 is an isometric illustration of the lid structure of FIG. 11 is an open and operative configuration.

FIGS. 11 and 12 illustrate a further modified container structure 10*b*, wherein a pivotal spout 29 is mounted to the further modified lid 28, whereupon a concave depression 30 permits access to a forward terminal end of the spout 29 to permit opening of the spout 29 mounted pivotally within the opening 31, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety drinking container apparatus comprising in combination, an elongate cylindrical container body, and a rigid lid mounted to an upper terminal end of the container body, the lid including an opening means mounted within the lid for providing access to contents contained within the container, and an opening mounted underlying the opening means within the lid when the opening means is in a first position adjacent the lid, and spout means in operative association with the opening means, wherein the spout means is directed through the opening when the opening means is in a second position rearwardly of the first position, and wherein the opening means includes a pull ring, the pull ring diametrically aligned to and integrally mounted to a forward terminal end of an elongate body, the elongate body including a rear body end, the rear body end fixedly mounted to the lid, and the elongate body including a tab member underlying the elongate body, wherein the tab member overlies the opening in the first position, and wherein the flexible tether line includes an upper terminal end and a lower terminal end, the upper terminal end mounted medially of the elongate body, and the tether line directed through the lid underlying the tab member and the lower terminal end of the tether line fixedly mounted to the spout means, and wherein the spout means includes an elliptical rigid base, the rigid base defined by a major axis, the tether line mounted to a forward terminal end of the rigid base at a forward terminal end of the major axis, and the rigid base hingedly mounted to the lid at a rear terminal end of the rigid base on the major axis, and a truncated conical spout positioned medially of the rigid base, wherein the conical spout includes an annular base, the annular base defines a predetermined diameter, and the opening is defined by a further diameter substantially equal to the predetermined diameter.

2. An apparatus as set forth in claim 1 wherein the opening includes a diametrically aligned opening leg directed interiorly of the lid diametrically aligned with the lid.

* * * * *